US007621536B2

(12) United States Patent
Orzech et al.

(10) Patent No.: US 7,621,536 B2
(45) Date of Patent: Nov. 24, 2009

(54) DISC CATCHING DEVICE

(75) Inventors: Joshua S. Orzech, Santa Cruz, CA (US); Scott W. Keasey, Soquel, CA (US)

(73) Assignee: Disc Golf Association, Aromas, CA (US)

( * ) Notice: Subject to any disclaimer, the term of this patent is extended or adjusted under 35 U.S.C. 154(b) by 0 days.

(21) Appl. No.: 11/643,401

(22) Filed: Dec. 21, 2006

(65) Prior Publication Data

US 2008/0153633 A1 Jun. 26, 2008

(51) Int. Cl.
*A63B 67/06* (2006.01)

(52) U.S. Cl. ..... 273/400; 473/476

(58) Field of Classification Search ..... 273/398–402
See application file for complete search history.

(56) References Cited

U.S. PATENT DOCUMENTS 4,461,484 A * 7/1984 Headrick ..... 273/400
4,527,721 A * 7/1985 Goldstein ..... 224/577
4,792,143 A * 12/1988 Headrick ..... 273/400
5,921,551 A * 7/1999 Dunipace ..... 273/400
6,494,455 B1 * 12/2002 Headrick ..... 273/400
6,554,285 B2 * 4/2003 Chittenden ..... 273/400
6,776,417 B1 * 8/2004 Holgate ..... 273/400
6,948,713 B1 * 9/2005 Grunfeld ..... 273/400
7,101,293 B2 * 9/2006 Tarng et al. ..... 473/446
2003/0025272 A1 * 2/2003 Billig et al. ..... 273/400

OTHER PUBLICATIONS

"Furture Sports Network—AudioVisual Disc Target (AVDT) Designing Tomorrows Sports Today", 1 page, Nov. 1995.
"Mach Lite", 2 pages, Dec. 1995.

* cited by examiner

*Primary Examiner*—Mark S Graham
(74) *Attorney, Agent, or Firm*—Seth Z. Kalson

(57) ABSTRACT

A disc catching device for catching a thrown disc, having a canopy structure, a basket structure, an assembly coupled to the canopy structure and the basket structure, and a pole to which the canopy structure and the basket structure may be attached. The assembly may engage a thrown disc, and for some embodiments, may comprise chains. When the disc catching device is deployed in its upright position for the sport of disc golf, the assembly hangs from the canopy structure, and is coupled to a ring that surrounds the pole. The basket structure comprises a set of basket arms, and when the disc catching device is deployed upright, the ring hangs below the set of basket arms. For some embodiments, the canopy structure and the basket structure may be foldable, like an umbrella. For some embodiments, the basket arms may be basket support arms, where each basket support arm supports a basket arm. Other embodiments are described and claimed.

19 Claims, 6 Drawing Sheets

DISC CATCHING DEVICE

FIELD

Embodiments of the present invention relate to sporting goods equipment, and more particularly, to a device for capturing a thrown disc, used in the sport of disc golf.

BACKGROUND

The sport of disc golf makes use of one or more discs, and one or more disc catching devices. As in regular golf, the object is to obtain the lowest score, where a point is added to a player's score each time a disc is thrown, and where the goal is to throw the disc so that it is caught by and retained in a disc catching device.

Disc golf was founded more than thirty years ago by Disc Golf Association, Inc., a California corporation based at 16 Maher Road, Watsonville, Calif. Disc Golf Association, Inc. was founded by "Steady" Ed Headrick, the inventor of the Frisbee®. Frisbee is a registered trademark of Wham-O, Inc., a Delaware corporation based at 5903 Christie Avenue, Emeryville, Calif. The disc catching device is sometimes referred to as a Disc Pole Hole® Disc Pole Hole is a registered trademark of Disc Golf Association, Inc.

DESCRIPTION OF EMBODIMENTS

In the descriptions that follow, the scope of the term "some embodiments" is not to be so limited as to mean more than one embodiment, but rather, the scope may include one embodiment, more than one embodiment, or perhaps all embodiments.

Figure 1:
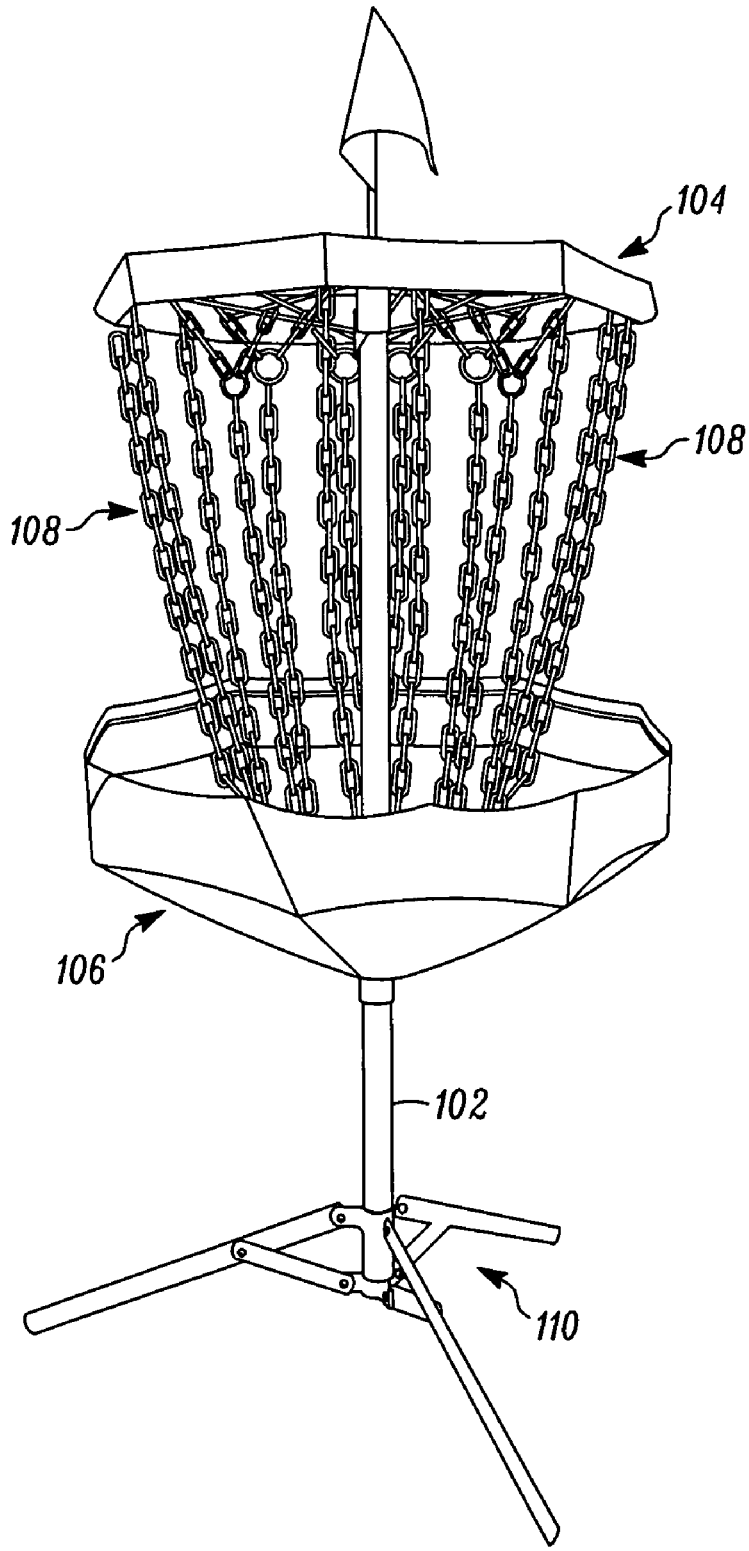
FIG. 1 illustrates an embodiment of the present invention in a deployed, upright position.

A simplified, perspective view of an embodiment of the present invention is illustrated in FIG. 1. The embodiment is shown in a deployed mode when used in the sport of disc golf. The illustration is approximately from the perspective of a typical player standing on the ground not far from the embodiment. When not in use, the embodiment may be folded into a more compact form factor. To present the overall form and shape of an embodiment in a non-cluttered fashion, detailed components are not illustrated in FIG. 1. However, general structural components may be pointed out.

The embodiment of FIG. 1 has pole 102, canopy structure 104, basket structure 106, and disc engaging assembly 108 coupled to canopy structure 104 and basket structure 106. For some embodiments, such as for the embodiment of FIG. 1, disc engaging assembly 108 may comprise chains. Pole 102 may comprise one or more pieces that are fitted together during deployment, and which may be disassembled from each other for compact storage. In the particular embodiment of FIG. 1, disc engaging assembly 108 comprise two independent assemblies, which will be described in more detail with respect to other drawings. Canopy structure 104 comprises an umbrella-like structure surrounded by a canopy cover made of fabric material, and basket structure 106 comprises an umbrella-like structure surrounded by a basket cover made of fabric material, and the structures for canopy structure 104 and basket structure 106 may be folded and unfolded like an umbrella. When the embodiment of FIG. 1 is set up for use, canopy structure 104 is near the top of pole 102, and basket structure 106 is below canopy structure 104. When a disc is thrown into disc engaging assembly 108, the momentum of the disc is absorbed so that the disc tends to fall into basket structure 106.

Figure 2:
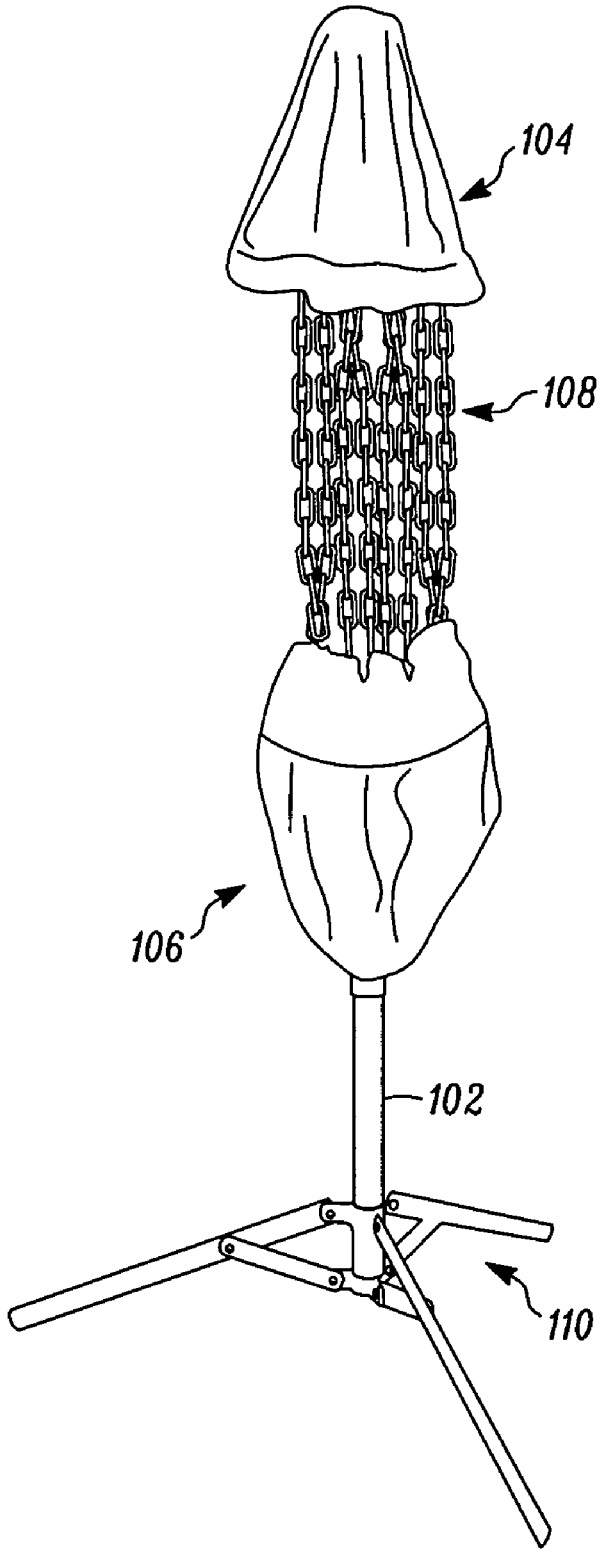
FIG. 2 illustrates an embodiment of the present invention in a folded position.

Leg structure 110 supports the overall structure of FIG. 1. Leg structure 110 may be folded when the embodiment of FIG. 1 is not in use. FIG. 2 provides a simplified, perspective view of the embodiment of FIG. 1 when in a folded position, except that leg structure 110 is still in its un-folded position.

Figure 3:
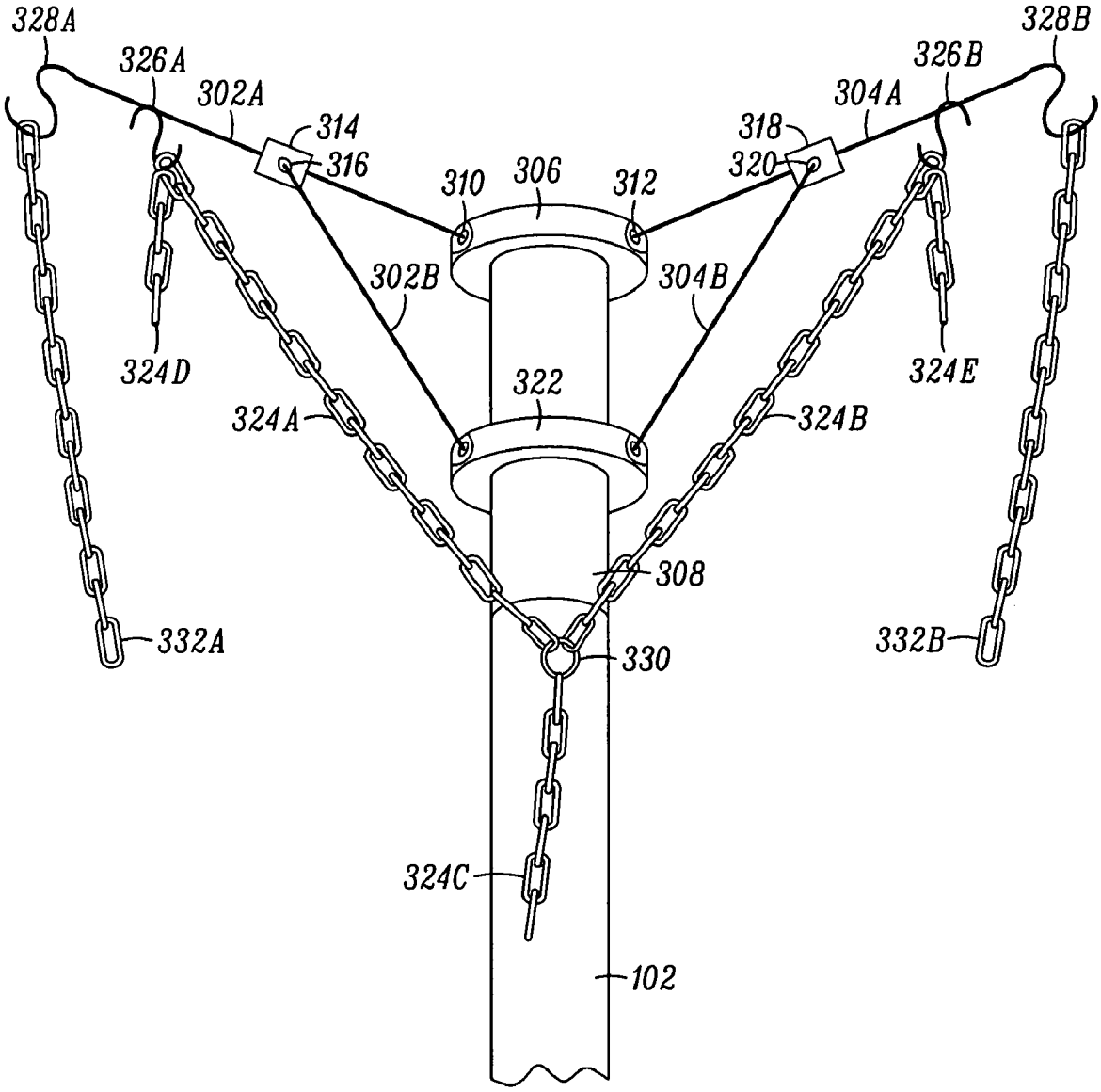
FIG. 3 illustrates part of an embodiment of the present invention, illustrating part of a canopy structure and part of two assemblies.

FIGS. 1 and 2 provide a simplified view of an embodiment, but not a detailed view of its components. FIG. 3 illustrates in more detail the structure of canopy structure 104, and the way in which disc engaging assembly 108 is coupled to canopy structure 104. The embodiment of FIG. 3 is illustrated from a perspective looking up into canopy structure 104. For simplicity, a canopy cover is not shown in FIG. 3, and only a small portion of the structure is shown. More particularly, canopy arms 302*a* and 304*a*, and canopy support arms 302*b* and 304*b*, form part of the structure. Stationary collar 306 is attached to pole 102, and moveable collar 308 fits over pole 102 so that it may slide on pole 102. When the embodiment is deployed for the sport of disc golf, stationary collar 306 is above moveable collar 308.

Canopy arm 302*a* is coupled to stationary collar 306 to pivot, or rotate, about coupling 310, and canopy arm 304*a* is coupled to stationary collar 306 to pivot, or rotate, about coupling 312. As one example of coupling 310, the end of canopy arm 302*a* that is coupled to stationary collar 306 may have a hole, where stationary collar 306 may have a pin that fits through the hole. In this way, canopy arm 302*a* may pivot, or rotate, with respect to stationary collar 306.

Canopy support arm 302*b* is coupled to sleeve 314 to pivot, or rotate, about coupling 316. Sleeve 314 is fixed on canopy arm 302*a* so as to be stationary with respect to canopy arm 302*a*. Canopy support arm 304*b* is coupled to sleeve 318 to pivot, or rotate, about coupling 320. Sleeve 318 is fixed on canopy arm 304*a* so as to be stationary with respect to canopy arm 304*a*. As one example of coupling 316, the end of canopy support arm 302*b* that is coupled to coupling 316 may have a hole, and sleeve 314 may include a pin, or rivet type element, through the hole so that canopy support arm 302*b* may pivot, or rotate, with respect to sleeve 314. In this way, when deployed, canopy support arm 302*b* provides support to canopy arm 302*a*, and canopy support arm 304*b* provides support to canopy arm 304*a*.

As discussed earlier, for simplicity only two canopy arms, and only two canopy support arms, are explicitly shown. However, in practice there are more than two canopy arms, and more than two canopy support arms. For some embodiments, each canopy arm has a corresponding canopy support arm, as discussed with respect to canopy arms 302*a* and 304*a*, and canopy support arms 302*b* and 304*b*. That is, for some embodiments, canopy structure 104 comprises a set of canopy arms and a set of canopy support arms, where there is a one-to-one correspondence between the set of canopy arms and the set of canopy support arms, e.g., where each canopy arm is supported by a canopy support arm. For some embodiments, the number of canopy arms need not be the same as the number of canopy support arms, so that there need not be a one-to-one correspondence.

Each canopy arm pivots, or rotates, with respect to stationary collar 306, and its corresponding canopy support arm pivots, or rotates, with respect to a corresponding sleeve on its corresponding canopy arm. The canopy support arms pivot, or rotate, with respect to moveable collar 308. In this way, by moving moveable collar 308 up or down pole 102, canopy structure 104 may be opened (un-folded) into a deployed position, or closed (folded), much like an umbrella. When opened, moveable collar 308 may be held stationary by a hook that engages top rim 322 of moveable collar 308. The hook may be moved out of the way when it is desired to fold the embodiment of FIG. 3. So as not to clutter the drawing of FIG. 3, the hook is not shown. By disengaging the hook, moveable collar 308 may slide down pole 102 so that canopy structure 104 collapses into a folded form factor. In other embodiments, a pin may be inserted in a hole below moveable collar 308 so that moveable collar 308 may rest on the pin when deployed.

Disc engaging assembly 108 comprises two assemblies, where one of the two assemblies may be termed an inner assembly, and the other assembly may be termed an outer assembly. Not all portions of the inner assembly are inside the outer assembly, but for some embodiments, near the top of pole 102, portions of the inner assembly are inside the outer assembly. Members of a portion of an inner assembly are labeled in FIG. 3 with labels 324*a* through 324*e*. This portion of the inner assembly is coupled to canopy arms 302*a* and 304*a*. More particularly, in the embodiment of FIG. 3, members 324*d* and 324*a* are directly coupled to hook 326*a*, and members 324*e* and 324*b* are directly coupled to hook 326*b*. Hook 326*a* may slide along canopy arm 302*a*, and hook 326*b* may slide along canopy arm 304*a*. However, their ranges of motion are limited by various structural components, such as for example ends 328*a* and 328*b* of canopy arms 302*a* and 304*b*, respectively, and sleeves 314 and 318. Hooks 326*a* and 326*b* have the appearance of an "S", but may take on other forms in other embodiments. Some embodiments may have members 324*a* and 324*d* coupled directly to canopy arm 302*a* without the use of a hook, so that one of the links in either member 324*a* or 324*d* is coupled to canopy arm 302*a* so as to have a range of motion along canopy arm 302*a*. A similar statement may apply to the rest of the inner assembly, such as for example members 324*b* and 324*e*.

Members 324*a*, 324*b*, and 324*c* are coupled together at ring 330. As a result, these members form the visual appearance of a "Y". For some embodiments, this arrangement may be described whereby canopy structure 104 comprises a set of canopy arms, and the inner assembly comprises a first set of members (e.g., members 324*a*, 324*b*, 324*d*, and 324*e*) where there is a one-to-one correspondence between each canopy arm and two members in the first set of members (e.g., there is a correspondence between canopy arm 302*a* and the two members 324*a* and 324*d*), where each member in the first set of members hangs from its corresponding canopy arm. The assembly further comprises a second set of members (e.g., member 324*c*), wherein for each member in the second set of members there corresponds two members in the first set of members (e.g., there is a correspondence between member 324*c* and the two members 324*a* and 324*b*), where each member in the second set of members is coupled to its two corresponding members in the first set of members. In the embodiment of FIG. 3, this coupling of the first and second set of members is by way of a third set of members (e.g., ring 330).

For some embodiments, members 324*a*, 324*b*, and 324*c* may be coupled directly to each other without use of ring 330. Only a few links for member 324*c* are shown for simplicity. In practice, member 324*c* continues downward so as to couple to basket structure 106, and this coupling will be discussed in more detail later.

Nearby ring 330, the angle between members 324A and 324B may vary from embodiment to embodiment, and depends on various parameters, such as for example, but not necessarily limited to, the spacing between adjacent canopy arms, e.g., canopy arms 302A and 304A, the length and weight of members 324A and 324B, and the positions of hooks 326A and 326B along their respective canopy arms, to name a few parameters. The angle between members 324A and 324B may easily fall within a relatively broad range. For example, embodiments may be constructed so that the angle may range from 30° to 150°, and even wider. However, if the angle is relatively small, then the number of such "Y" shaped combination of members may be relatively large, adding to the cost and weight of the embodiment. On the other hand, if the angle is relatively large, then the "Y" shaped combination of members may not be as effective in absorbing the momentum of a thrown disc as for other angles between the members. For some embodiments, the angle of the top two branches of the "Y", e.g., members 324A and 324B, may be about 90°. But clearly this angle may less or more than 90° by a substantial amount.

Members 324*d* and 324*e* are illustrated in FIG. 3 as comprising only a few links. This was done for ease of illustration. As discussed previously, more than two canopy arms are used in an embodiment, and accordingly, the inner assembly is coupled to these other canopy arms making up canopy structure 104. Only a relatively small portion of the inner assembly is explicitly shown in FIG. 3. In practice, members 324*d* and 324*e* continue, coupling to other rings similar to that of ring 330, where these other rings are coupled to other members of the inner assembly, so that the inner assembly is coupled to other canopy arms making up canopy structure 104. The members making up the inner assembly are coupled to basket structure 106, which will be described in more detail later.

Members 332*a* and 332*b* are two members of the outer assembly. In practice, the outer assembly comprises more than two members. The top of member 332*a* is coupled to end 328*a* of canopy arm 302*a*, and the top of member 332*b* is coupled to end 328*b* of canopy arm 304*a*. In the embodiment of FIG. 3, ends 328*a* and 328*b* are loops of their respective canopy arms. The bottoms of members 332*a* and 332*b* are coupled to basket structure 106. Similarly, the bottoms of the other members (not shown) of the outer assembly are coupled to basket structure 106, which will be described in more detail later.

When the embodiment of FIG. 3 is deployed in the field for the sport of disc golf, hooks 326*a* and 326*b* rest against, or nearby, sleeves 314 and 318, respectively. Similarly, other hooks (not shown) rest against, or nearby, their respective sleeves (not shown). If a disc, thrown into the embodiment of FIG. 3, were to engage the inside face of member 324*a*, 324*b*, 324*c*, or ring 330, or some combination thereof, then hook 326*a* may slide along canopy arm 302*a* toward end 328*a*, or hook 326*b* may slide along canopy arm 304*a* toward end 328*b*, or both. The "inside face" of these elements may be viewed as that portion of disc engaging assembly 108 facing pole 102. If disc engaging assembly 108 is made out of chains, then because the chains may twist and bend, the inside face may not correspond to a permanently well-defined physical part of the chains, so that the inside face may be viewed as that portion of disc engaging assembly 108, even if transitory, facing pole 102.

By sliding toward ends 328*a* or 328*b*, the inner assembly, as it moves, absorbs some of the momentum of a thrown disc that engages the inside face of the inner assembly. It is believed that the rate at which momentum is absorbed is less than for the case in which the inner assembly is fixed to the canopy arms, all other parameters being equal. Consequently, it is believed that the movement of the inner assembly along the canopy arms allows the momentum of a thrown disc that engages the inner assembly at its inside face to be absorbed more gradually then if the inner assembly were fixed to the canopy arms, and that this characteristic of an embodiment may facilitate in allowing a thrown disc to fall into basket structure 106. However, this characteristic is not necessarily a feature of some embodiments. For some embodiments, the inner assembly may be attached to canopy structure 104 so that it does not slide along the canopy arms that form part of canopy structure 104. Accordingly, this characteristic is not to be construed as a necessary feature; it may be present in some embodiments according to the invention, and it may not be present in some embodiments according to the invention.

There is another characteristic of the embodiment of FIG. 3 in the way that the momentum of a thrown disc may be absorbed by the inner assembly. One may imagine that members 324*a*, 324*b*, and 324*c* roughly define a plane. If a disc hits member 324*c* while traversing a trajectory that is roughly parallel to such a defined plane, then the end portion of member 324*c* coupled to ring 330 may move up along ring 330 so as to help absorb some of the momentum of the thrown disc. Also, member 324*a* may pivot about its coupling to hook 326*a*, or member 324*b* may pivot about its coupling to hook 326*b*, depending upon from which direction a disc hits the inner assembly, and this characteristic may further help absorb some of the momentum of the thrown disc. It is believed that these characteristics may further help in allowing a disc thrown into the inner assembly to fall into basket structure 106. However, these characteristics are not to be construed as a necessary feature; they may be present in some embodiments according to the invention, and they may not be present in some embodiments according to the invention.

Figure 4:
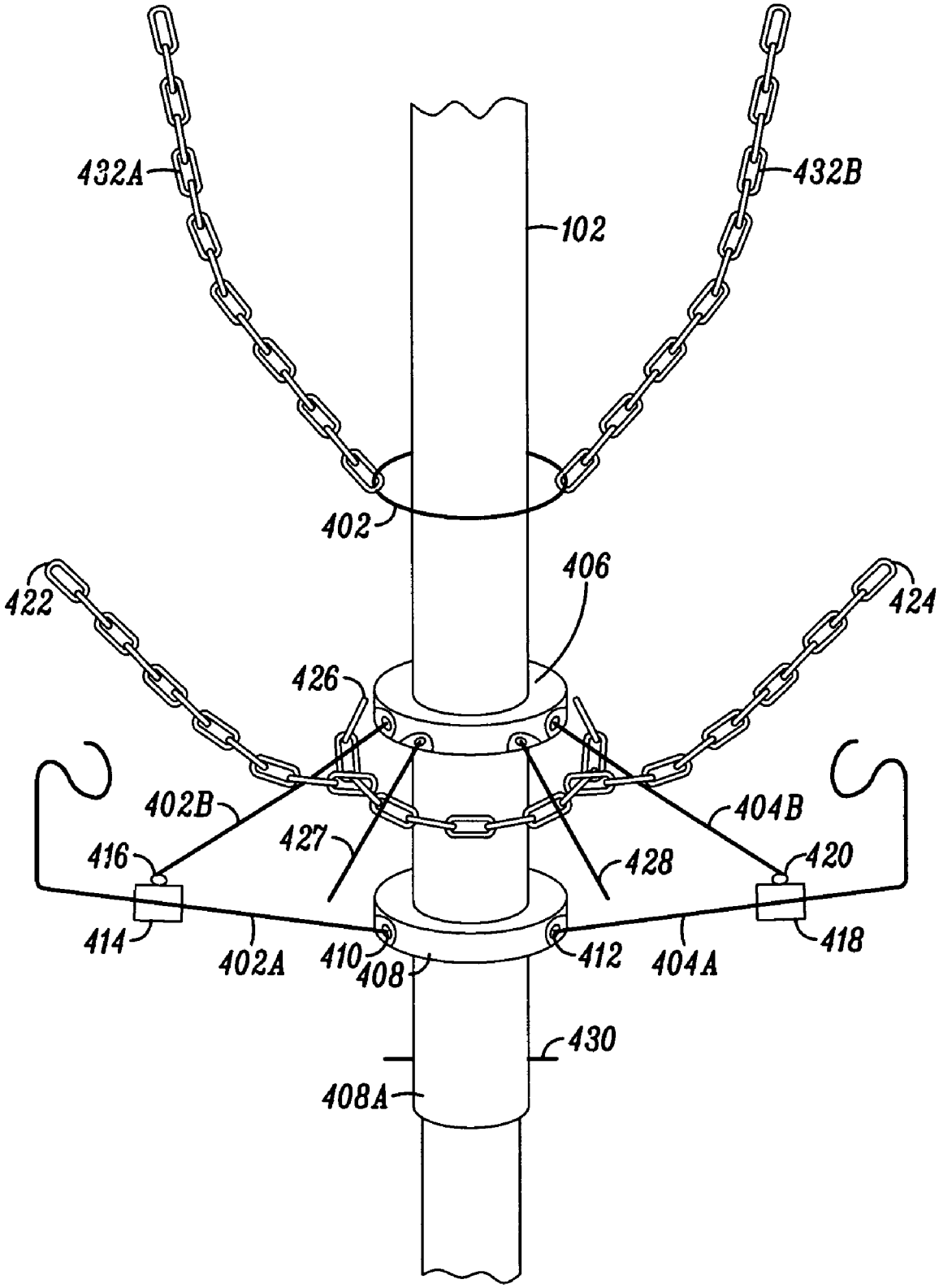
FIG. 4 illustrates part of an embodiment of the present invention, illustrating part of a basket structure and part of two assemblies.

FIG. 4 illustrates an embodiment from a perspective looking into basket structure 106. For simplicity, the basket cover is not shown, and only some portions of disc engaging assembly 108 and basket structure 106 of an embodiment are shown.

Members 432*a* and 432*b* comprise part of the outer assembly, and may be thought of as connected to members 332*a* and 332*b*, respectively, or stated alternatively, that members 432*a* and 332*a* are portions of a single member in the outer assembly, and members 432*b* and 332*b* are portions of a single member in the outer assembly. These members attach to ring 402. Ring 402 is positioned above (when the embodiment is standing upright) basket structure 106.

Basket structure 106 comprises a set of basket arms, where for simplicity only two basket arms, basket arms 402*a* and 404*a*, are explicitly shown in FIG. 4. Basket structure 106 also comprises a set of basket support arms. In FIG. 4, basket support arms 402*b* and 404*b* provide, respectively, support to basket arms 402*a* and 404*a*. Stationary collar 406 is attached to pole 102, and moveable collar 408 fits over pole 102 so that it may slide on pole 102. When the embodiment is deployed for the sport of disc golf, stationary collar 406 is above moveable collar 408.

Basket arm 402*a* is coupled to moveable collar 408 to pivot, or rotate, about coupling 410, and basket arm 404*a* is coupled to moveable collar 408 to pivot, or rotate, about coupling 412. As one example of coupling 410, the end of basket arm 402*a* that is coupled to moveable collar 408 may have a hole, where moveable collar 408 may have a pin that fits through the hole. In this way, basket arm 402*a* may pivot, or rotate, with respect to moveable collar 408.

Basket support arm 402*b* is coupled to sleeve 414 to pivot, or rotate, about coupling 416. Sleeve 414 is fixed on basket arm 402*a* so as to be stationary with respect to basket arm 402*a*. Basket support arm 404*b* is coupled to sleeve 418 to pivot, or rotate, about coupling 420. Sleeve 418 is fixed on basket arm 404*a* so as to be stationary with respect to basket arm 404*a*. As one example of coupling 416, the end of basket support arm 402*b* that is coupled to coupling 416 may have a hole, and sleeve 414 may include a pin, or rivet type element, through the hole so that basket support arm 402*b* may pivot, or rotate, with respect to sleeve 414. In this way, when deployed, basket support arm 402*b* provides support to basket arm 402*a*, and basket support arm 404*b* provides support to basket arm 404*a*.

As discussed earlier, for simplicity only two basket arms, and only two complete basket support arms, are explicitly shown. However, in practice there are more than two basket arms, and more than two basket support arms. For some embodiments, each basket arm has a corresponding basket support arm, as discussed with respect to basket arms 402*a* and 404*a*, and basket support arms 402*b* and 404*b*. That is, for some embodiments, basket structure 106 comprises a set of basket arms and a set of basket support arms, where there is a one-to-one correspondence between the set of basket arms and the set of basket support arms, e.g., where each basket arm is supported by a basket support arm. For some embodiments, the number of basket arms need not be the same as the number of basket support arms, so that there need not be a one-to-one correspondence.

Once unfolded, basket structure 106 may be secured in its unfolded position in a number of ways. For example, in the embodiment of FIG. 4, pin 430 may be inserted through holes (not shown) in the base of moveable collar 408, indicated by label 408*a*, and through holes (not shown) in pole 102.

From the above description, it should be noted that the action of folding and unfolding canopy structure 104 comprising the canopy arms and their corresponding canopy support arms is very similar to the common umbrella, and may be nearly identical to some types of umbrellas. The action of folding and unfolding basket structure 106 comprising the basket arms and their corresponding basket support arms is also very similar to the common umbrella, except perhaps that the basket arms are coupled to a moveable collar, whereas their corresponding basket support arms are coupled to a stationary collar. Embodiments may be manufactured in which the canopy arms are coupled to a moveable collar, with their corresponding canopy support arms coupled to a stationary collar; and in which the basket arms are coupled to a stationary collar, with their corresponding basket support arms coupled to a moveable collar. However, this later type of embodiment may not be as easily folded and unfolded as the other described embodiment.

The inner assembly is coupled to a member, labeled 426, which is situated completely below the basket support arms when the embodiment of FIG. 4 is deployed in an upright position. That is, when the disc catching device as illustrated in FIG. 4 is standing in an upright position, and the inner assembly has not been disturbed (e.g., no disc has recently engaged the inner assembly), then under normal conditions member 426 will hang below the basket support arms. In FIG. 4, portions of two members of the inner assembly, member 422 and member 424, are shown coupled to member 426. For simplicity, only a portion of member 426 is shown, but in the embodiment of FIG. 4, member 426 is a ring about pole 102, and will be referred to as ring 426 when describing the embodiment of FIG. 4. In the particular embodiment of FIG. 4, ring 426 is a chain. Portions of two more basket support arms, labeled as 427 and 428, are shown. Ring 426 is situated below basket support arms 402*b*, 404*b*, 427, and 428.

When the embodiment of FIG. 4 is deployed in its upright position, ready for the sport of disc golf, member 422 is coupled to ring 426 and is coupled to canopy structure 104 so that a lower portion of member 422 dangles between basket support arms 402*b* and 427; and member 424 is coupled to ring 426 and is coupled to canopy structure 104 so that a lower portion of member 422 dangles between basket support arms 404*b* and 428. The point at which member 422 couples to ring 426, and the point at which member 424 couples to ring 426, lie below basket support arms 402*b*, 404*b*, 427, and 428 when the embodiment of FIG. 4 is deployed in its upright position.

In practice, the inner assembly comprises relatively long members, such as members 324*c*, 422, and 424. For simplicity, only one such member, member 324*c*, is explicitly shown in FIG. 3; and only two such members, members 422 and 424, are explicitly shown in FIG. 4. In the embodiment of FIG. 4, member 422 is coupled to a ring similar to ring 330, and member 424 is also coupled to a ring similar to ring 330.

When a disc engages the inner assembly, such as for example member 422 or member 424, ring 426 will generally rise, and will then come into contact against the underside of one or more of the basket support arms because ring 426 is situated below the basket support arms. For some embodiments, the vertical travel of ring 426 may be a couple of inches before it first comes in contact with one of the basket support arms. If ring 426 is flexible, which is the case for the particular embodiment of FIG. 4, parts of ring 426 may continue to be pulled upward until it cannot be pulled upward anymore because of contact with one or more of the basket support arms. For some embodiments, the part of ring 426 coupled to the member of the inner assembly engaging a thrown disc may move upward another couple of inches before ring 426 stops moving upward. For some embodiments, the total vertical travel of the part of ring 426 coupled to a member of the inner assembly engaging a thrown disc may be about four inches. However, it should be noted that the dimensions cited for the vertical travel of ring 426 for some embodiments is only approximate, and is only meant to aid in the understanding of some embodiments, and that the vertical travel of ring 426 may, for some embodiments, vary by a relatively large amount from the example cited herein.

When the vertical travel of ring 426 is stopped due to contact with the basket support arms, the time rate of change of momentum of an engaged disc is larger in magnitude than when the ring 426 is still being pulled upward by the inner assembly. It is believed that this change in the time rate of change of momentum may aid in causing a thrown disc to fall into basket structure 106. However, this characteristic is not to be construed as a necessary feature; it may be present in some embodiments according to the invention, and it may not be present in some embodiments according to the invention. Furthermore, in some embodiments, ring 426 may be fixed, or may be absent entirely, whereby the inner assembly is affixed to basket structure 106 or pole 102.

In the embodiments illustrated in FIGS. 1 through 4, the inner and outer assemblies, as well as ring 426, were illustrated as comprising chains, and for some embodiments, these chains are made out of metal. However, other embodiments may utilize different structures for the assemblies and ring 426. Some embodiments may utilize ropes for the assemblies and ring 426, or portions thereof. Such ropes may be made out of various materials. Or, as another example, the assemblies and ring 426 may be chains, but made out of some material other than metal, such as plastic or rubber, for example. Similarly, other components may be made out of metal, plastic, rubber, or other types of material. For example, ring 402 may be metal, or some material other than metal.

Figure 5:
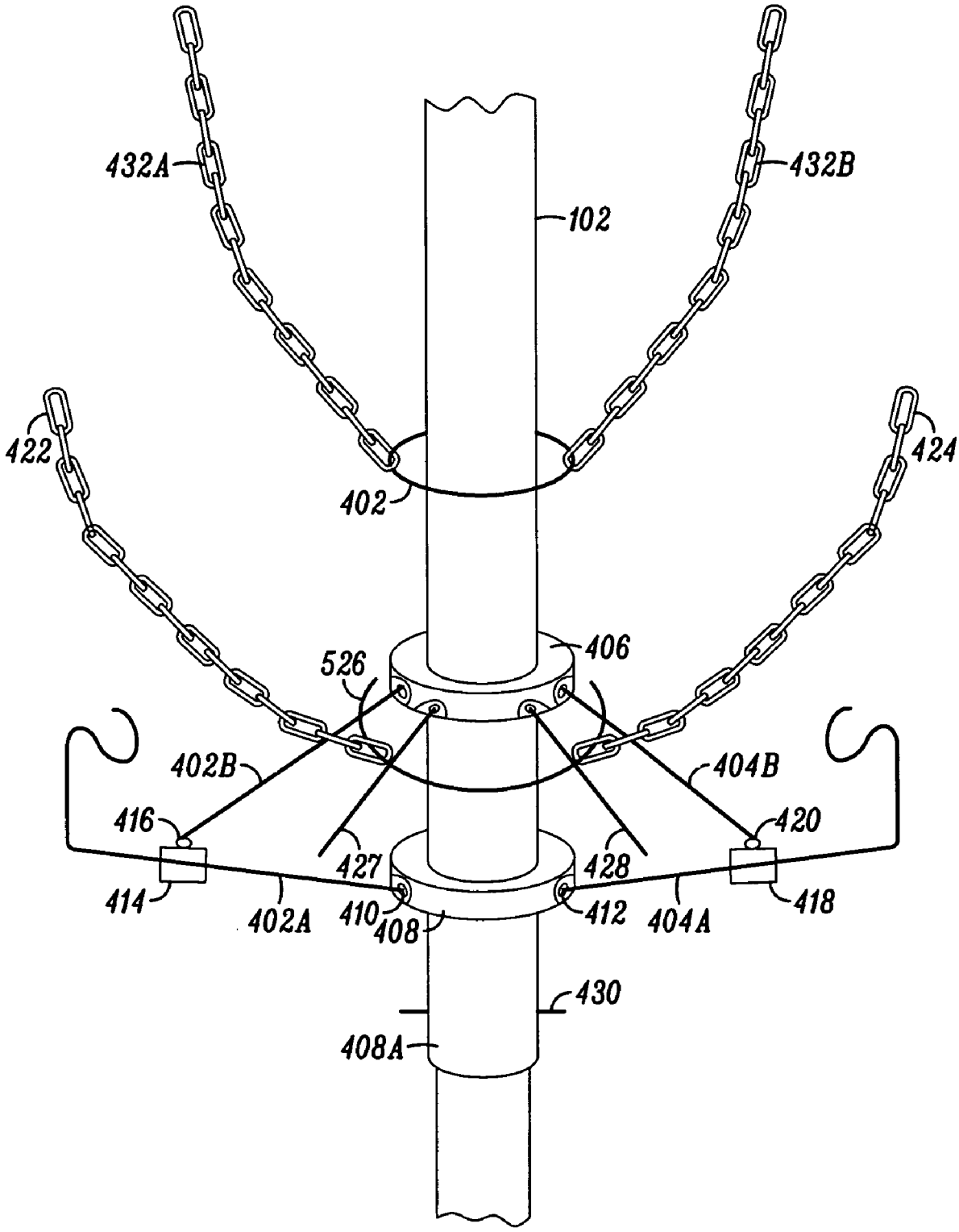
FIG. 5 illustrates part of an embodiment of the present invention, illustrating part of a basket structure and part of two assemblies.

For example, the embodiment illustrated in FIG. 5 is similar to that of FIG. 4, but where ring 526 is not a chain-type structure. Ring 526 may be non-flexible for some embodiments, or flexible for others. Furthermore, rings 330 and 402 may not be ring-shaped. Indeed, some of these components may not be present in some embodiments. For example, ring 330 may be eliminated, so that members 324*a*, 324*b*, and 324*c* are coupled at a link.

For some embodiments, the inner assembly as describe above may actually be on the outside of the outside assembly. Accordingly, the adjectives "inner" and "outer" have been used merely for convenience, and the assembly coupled to ring 426 or ring 526 may, as it nears canopy structure 104, be on the outside of the assembly that is coupled to ring 402. For some embodiments, there may only be one assembly, so that there is an assembly coupled to ring 426 or 526, but there is no ring 402 and its accompanying assembly.

Figure 6:
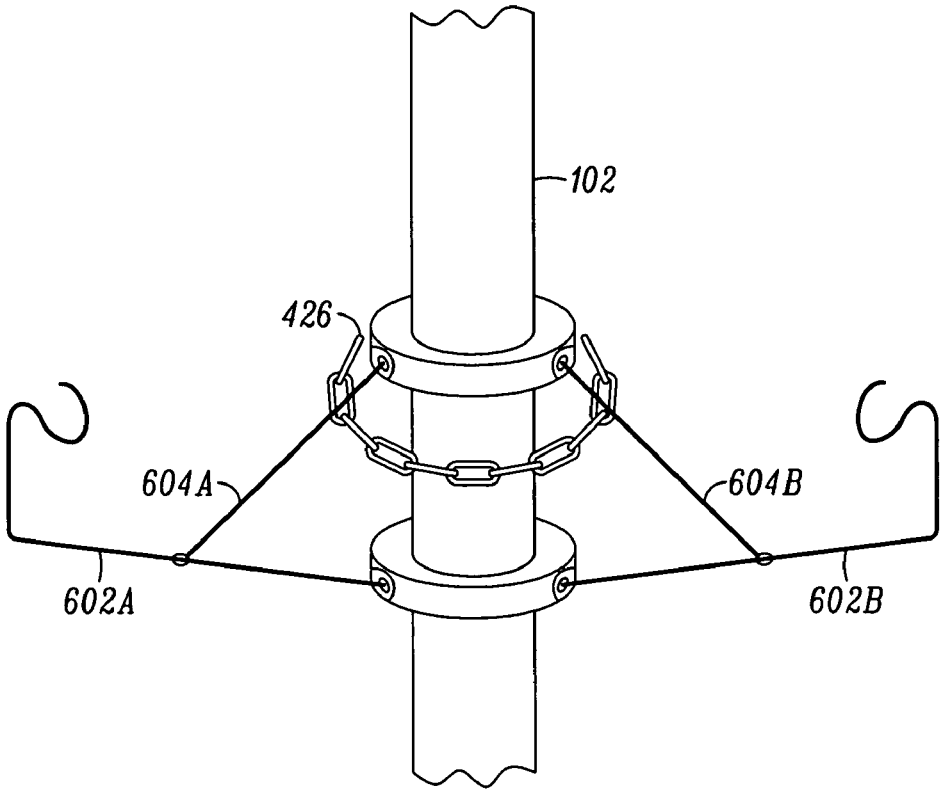
FIG. 6 illustrates part of an embodiment of the present invention, illustrating part of a basket structure.

The above-described embodiments are disc catching devices that have umbrella-like canopy and basket structures that may be folded when not in use. However, other embodiments may have a canopy structure or basket structure, or both, that are fixed and may not be folded and unfolded. For example, FIG. 6 illustrates a portion of an embodiment from a perspective looking down into basket structure 106, but where basket arm 602*a* and basket support arm 604*a* are rigidly connected to each other and to pole 102, and basket arm 602*b* and basket support arm 604*b* are rigidly connected to each other and to pole 102. Ring 426 is situated underneath basket support arms 604*a* and 604*b*. For simplicity, other basket arms and basket support arms are not shown.

The illustrations depicted in the figures are perspective views of the embodiments. However, it should be appreciated that these perspective views are somewhat idealized to simplify the drawings, and should not be taken as exact views of working embodiments. As one example, regarding FIG. 4, embodiments have been constructed in which, if one were to look downward into basket structure 106, ring 402 would most likely partially obscure stationary collar 406. However, to simplify the drawing, FIG. 4 is drawn such that ring 402 does not obscure stationary collar 406.

Furthermore, so as not to obscure the drawings, it should be appreciated that not all of the hardware for a typical embodiment is shown. For example, collars 306 and 322 may have screws holding together various components, and coupling 310 may include a pin that goes through an opening at the end of canopy arm 302*a*, but where the pin is formed from part of collar 306.

Figure 7:
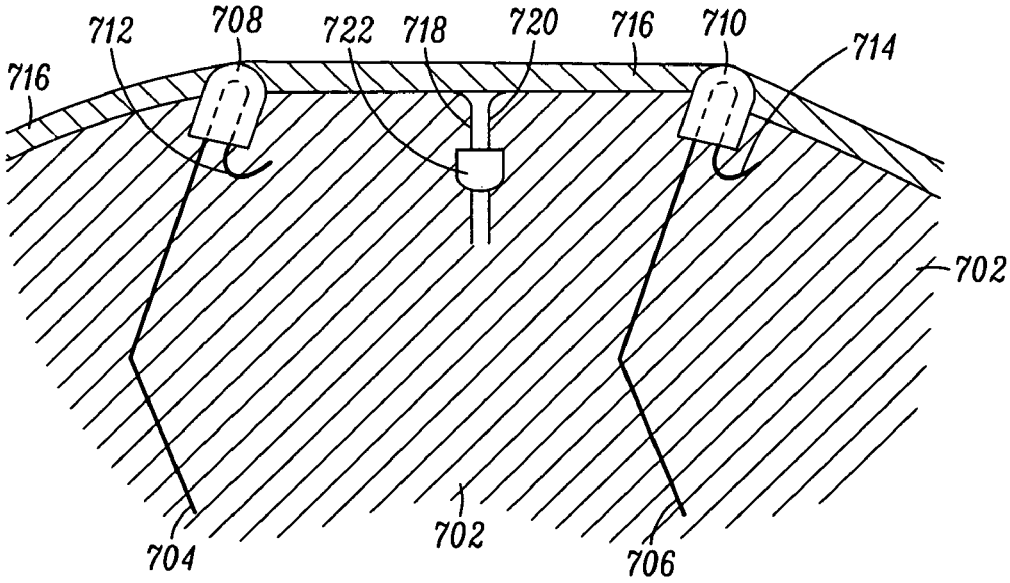
FIG. 7 illustrates part of an embodiment of the present invention, illustrating a canopy cover with a draw cord.

For folding embodiments where the basket structure is umbrella-like, some embodiments may utilize a draw-cord in the basket cover to add additional structural rigidity. An embodiment is illustrated in FIG. 7, from a perspective looking into basket 106 from nearby pole 102. Portions of basket cover 702 are indicated in FIG. 7, and portions of two basket arms are shown, labeled as 704 and 706. Basket cover 702 includes pocket 708 that fits over end 712 of basket arm 704, and includes pocket 710 that fits over end 714 of basket arm 706. Basket cover 702 includes a fold (or cuff) 716. Inside fold 716 is a draw cord. Two ends of the draw cord exit fold 716 and are labeled as 718 and 720. These two ends fit through cord tightening device 722. Cord tightening device 722 may be anyone of a number of devices for tightening two ends of a cord, and may be found in various consumer products, such as a tightening device for the cord in a duffle bag, a tightening device for the laces of an inline roller skate, etc. For example, cord tightening device 722 may comprise a cog, or gear, (not shown) with teeth to grip the two ends of the cord, so that they may be tightened by pulling on the ends and moving cord tightening device 722 toward fold 716. In other embodiments, one end of the draw cord may be sewed to basket cover 702, so that only one end is threaded through a tightening device. By tightening the draw cord, basket cover 702 is held tightly around the basket arms to provide additional rigidity.

Various modifications may be made to the disclosed embodiments without departing from the scope of the invention as claimed below. For example, as discussed with respect to FIG. 4, basket structure 106 may fold and unfold in which collar 406 is moveable rather than stationary. Accordingly, some embodiments may have a basket structure in which the basket support arms are below the basket arms, so that ring 426 is situated below the basket arms. Furthermore, as discussed with respect to FIG. 6, basket structure 106 may not be of the folding type. Accordingly, there may be some embodiments without basket support arms, so that ring 426 may be considered to be situated below a set of basket arms.

What is claimed is:

1. A disc catching device comprising:

a pole;

a canopy structure;

a set of basket arms;

a member surrounding the pole so that when the disc catching device is deployed in an upright position, the member lies completely below the set of basket arms when the member is not disturbed; and an assembly coupled to the canopy structure and directly connected to the member, but not connected to the set of basket arms.

2. The disc catching device as set forth in claim 1, wherein each basket arm is a basket support arm.

3. The disc catching device as set forth in claim 1, wherein the member is a chain ring comprising a metal.

4. The disc catching device as set forth in claim 1, the assembly comprising chains comprising a metal.

5. The disc catching device as set forth in claim 1, wherein the canopy structure may be folded and unfolded.

6. The disc catching device as set forth in claim 5, the canopy structure further comprising a canopy cover.

7. The disc catching device as set forth in claim 1, further comprising a basket structure, wherein each basket arm is a basket support arm so that the basket structure comprises a set of basket support arms, and the basket structure comprises a set of basket arms so that there is a one-to-one correspondence between the set of basket arms and the set of basket support arms.

8. The disc catching device as set forth in claim 7, wherein the basket structure may be folded and unfolded.

9. The disc catching device as set forth in claim 8, the basket structure further comprising a basket cover, the basket cover including a fold, the basket structure further comprising a draw cord, wherein a portion of the draw cord is inserted in the fold of the basket cover.

10. The disc catching device as set forth in claim 1, further comprising:

a second assembly coupled to the canopy structure; and a second member coupled to the second assembly and surrounding the pole at a position above the set of basket arms when the disc catching device is deployed in an upright position.

11. The disc catching device as set forth in claim 1, the canopy structure further comprising a set of canopy arms, the assembly comprising a set of members so that there is a one to one correspondence between the set of members and the set of canopy arms, wherein each member of the assembly may slide along a portion of its corresponding canopy arm.

12. A disc catching device comprising:

a pole;

a canopy structure comprising a set of canopy arms; and an assembly coupled to the canopy structure, the assembly comprising a first set of members, each member in the first set of members comprising chains, wherein there is a correspondence between the first set of members and the set of canopy arms such that for each canopy arm in the set of canopy arms there corresponds two members in the first set of members, wherein each member in the first set of members is coupled to slide along its corresponding canopy arm; the assembly further comprising a second set of members, each member in the second set of members comprising chains, wherein there is a correspondence between the second set of members and the first set of members so that for each member in the second set of members there corresponds two members in the first set of members, wherein each member in the second set of members is coupled to its two corresponding members in the first set of members; and a member surrounding the pole, where each member in the second set of members is coupled to the member surrounding the pole.

13. The disc catching device as set forth in claim 12, the assembly further comprising a third set of members such that there is a one-to-one correspondence between the third set of members and the second set of members, wherein each member in the second set of members and its two corresponding members in the first set of members are coupled by way of its corresponding member in the third set of members.

14. The disc catching device as set forth in claim 13, wherein each member in the third set of members is a ring.

15. A disc catching device comprising:

a pole;

a set of basket arms;

a canopy structure comprising a set of canopy arms;

an assembly coupled to the canopy structure, the assembly comprising a first set of members, wherein there is a correspondence between the first set of members and the set of canopy arms such that for each canopy arm in the set of canopy arms there corresponds two members in the first set of members defining an angle in the range of 30° to 150°; the assembly further comprising a second set of members, wherein there is a correspondence between the second set of members and the first set of members so that for each member in the second set of members there corresponds two members in the first set of members, wherein each member in the second set of members is coupled to its two corresponding members in the first set of members; and a member surrounding the pole, where each member in the second set of members is coupled to the member surrounding the pole at multiple points, where the multiple points lie below the set of basket arms when not engaging the assembly.

16. The disc catching device as set forth in claim 15, the assembly further comprising a third set of members such that there is a one-to-one correspondence between the third set of members and the second set of members, wherein each member in the second set of members and its two corresponding members in the first set of members are coupled by way of its corresponding member in the third set of members.

17. The disc catching device as set forth in claim 16, wherein each member in the third set of members is a ring.

18. The disc catching device as set forth in claim 15, wherein for each canopy arm in the set of canopy arms there corresponds two members in the first set of members defining an angle in the range of 60° to 120°.

19. The disc catching device as set forth in claim 15, wherein for each canopy arm in the set of canopy arms there corresponds two members in the first set of members defining an angle of about 90°.

* * * * *